US009385436B2

(12) United States Patent
Milroy et al.

(10) Patent No.: US 9,385,436 B2
(45) Date of Patent: Jul. 5, 2016

(54) DUAL-BAND DICHROIC POLARIZER AND SYSTEM INCLUDING SAME

(71) Applicant: ThinKom Solutions, Inc., Torrance, CA (US)

(72) Inventors: William Milroy, Torrance, CA (US); James Sor, San Pedro, CA (US); William Henderson, Bedford, NH (US)

(73) Assignee: THINKOM SOLUTIONS, INC., Torrance, CA (US)

( * ) Notice: Subject to any disclaimer, the term of this patent is extended or adjusted under 35 U.S.C. 154(b) by 417 days.

(21) Appl. No.: 13/945,489

(22) Filed: Jul. 18, 2013

(65) Prior Publication Data

US 2015/0022409 A1 Jan. 22, 2015

(51) Int. Cl.
*H01Q 15/24* (2006.01)
*H01Q 5/28* (2015.01)

(52) U.S. Cl.
CPC ..... *H01Q 15/244* (2013.01); *H01Q 5/28* (2015.01); *H01Q 15/242* (2013.01)

(58) Field of Classification Search
CPC ..... H01Q 15/244; H01Q 15/242; H01Q 5/28
See application file for complete search history.

(56) References Cited

FOREIGN PATENT DOCUMENTS

EP 2 469 653 A1 6/2012

OTHER PUBLICATIONS

European Search Report issued on Dec. 17, 2014 for corresponding European Application No. 14177326.7.
Irfan Sohail et al., "A linear to circular polarization converter based on Jerusalem-Cross frequency selective surface", Antennas and Propagation (EUCAP), 2013 7th European Conference, IEEE, Apr. 8, 2013, pp. 2141-2143, XP032430436.
Yogesh Ranga et al., "An anisotropic impedance surface for dual-band linear-to-circular transmission polarization convertor", Antenna Tehcnology (IWAT), 2013 International Workshop, IEEE Mar. 4, 2013, p. 47-50, XP032409757.

*Primary Examiner* — Hoang V Nguyen
*Assistant Examiner* — Michael Bouizza
(74) *Attorney, Agent, or Firm* — Renner, Otto, Boisselle & Sklar, LLP

(57) ABSTRACT

A dual-band dichroic polarizer is provided for converting linearly polarized electromagnetic energy within distinct frequency bands into oppositely polarized circularly polarized electromagnetic energy. The polarizer includes an array of unit cells distributed across a sheet, wherein the unit cells each include a stack of one or more resonant structures, the stack configured to introduce a phase differential of approximately +90° to linearly polarized electromagnetic energy within a first distinct frequency band that is incident upon and passes through the sheet, and configured to introduce a phase differential of approximately −90° to linearly polarized electromagnetic energy within a second distinct frequency band, separate from the first distinct frequency band, that is incident upon and passes through the sheet, a linear polarization of the electromagnetic energy in the first distinct frequency band and a linear polarization of the electromagnetic energy in the second distinct frequency band being the same.

20 Claims, 7 Drawing Sheets

(i)

(ii)

(i)

(ii)

(i)

(ii)

DUAL-BAND DICHROIC POLARIZER AND SYSTEM INCLUDING SAME

TECHNICAL FIELD

The present invention relates generally to polarizers which convert the polarization of electromagnetic waves into another polarization, and systems incorporating the same.

BACKGROUND ART

A single antenna aperture that can simultaneously cover multiple bands with proper polarization is highly attractive since this greatly simplifies system complexity and cost. For example, distinct frequency bands (e.g., K- and Ka-frequency bands) often times together form an important and popular downlink/uplink pairing. From the perspective of a ground terminal, the polarization assignment for these bands is typically left-hand circular polarization (LHCP) and right-hand circular polarization (RHCP), respectively.

Polarizers can take on many forms and functions. In frequency spectrums where linear polarization dominates (e.g., Ku-band), a commonly used polarizer is the twist polarizer which takes an input linearly-polarized wave in one direction and twists it to a differently oriented (but still linear) polarization. A different type of polarizer is the meanderline polarizer which converts an input linearly polarized wave to circular polarization.

There are several existing approaches to providing dual orthogonal polarization outputs from a common shared aperture. A popular solution for dish/reflector-type antennas is to employ a circular feed horn together with an orthomode transducer. This dish setup outputs two orthogonal linear channels, which can be phased to receive/transmit LHCP or RHCP for that band. A second feed horn illuminating the same common dish/reflector can provide additional coverage in another band. Similar implementations exist for other transmission mediums (i.e. dual aperture-coupled patch) but these all operate on the same principle of providing dual orthogonal output channels. A meanderline polarizer placed at the output of these apertures can convert these two orthogonal linearly polarized waves into separate orthogonal RHCP and LHCP signals.

However, each of these existing arrangements require antennas that support two orthogonal polarizations. What is needed is a polarizer that can instead operate on just a single polarization, greatly reducing system complexity and costs. In the K/Ka downlink/uplink frequency spectrums, for example, such a polarizer needs to convert an input linearly polarized electromagnetic wave to one sense of circular polarization (CP) (e.g, LHCP) in the first band and the opposite sense of CP (e.g. RHCP) in the second band.

SUMMARY OF INVENTION

According to an aspect, a dual-band dichroic polarizer is provided for converting linearly polarized electromagnetic energy within distinct frequency bands into oppositely polarized circularly polarized electromagnetic energy. The polarizer includes an array of unit cells distributed across a sheet, wherein the unit cells each include a stack of one or more resonant structures, the stack configured to introduce a phase differential of approximately +90° to linearly polarized electromagnetic energy within a first distinct frequency band that is incident upon and passes through the sheet, and configured to introduce a phase differential of approximately −90° to linearly polarized electromagnetic energy within a second distinct frequency band, separate from the first distinct frequency band, that is incident upon and passes through the sheet, a linear polarization of the electromagnetic energy in the first distinct frequency band and a linear polarization of the electromagnetic energy in the second distinct frequency band being the same. The phase differential is defined as the difference between the phases of linearly polarized signals that are polarized along the two principal axes of the polarizer.

According to another aspect, the sheet comprises m stacked layers (where m is an integer equal to or greater than 2), and each of the unit cells includes a stack of resonant structures formed respectively in or on the stacked layers.

In accordance with another aspect, the stacked resonant structures in each unit cell individually introduce a phase differential of approximately +90°/m to the linearly polarized electromagnetic energy within the first distinct frequency band and a phase differential of approximately −90°/m to the linearly polarized electromagnetic energy within the second distinct frequency band.

According to another aspect, m equals 4.

In accordance with yet another aspect, the sheet comprises a dielectric sheet.

According to still another aspect, the first distinct frequency band is in the K-band spectrum and the second distinct frequency band is in the Ka-band spectrum.

In still another aspect, constituent parts of each resonant structure include at least two different patches and/or apertures selected from a group of geometries consisting of a monopole structure, a cross-structure, complementary corner structures, a Jerusalem cross-structure, and a turnstile structure.

According to another aspect, the constituent parts include a cross-structure and complementary corner structures.

In yet another aspect, each resonant structure comprises at least one of a monopole and simple cross.

In accordance with another aspect, a system for transmitting and receiving electromagnetic energy is provided. The system includes a receiver configured to receive electromagnetic energy within a first distinct frequency band; a transmitter configured to transmit electromagnetic energy within a second distinct frequency band, separate from the first distinct frequency band; one or more antennas operatively configured to receive and transmit the electromagnetic energy in the first and second distinct frequency ranges with a same linear polarization; and a dual-band dichroic polarizer configured to convert circularly polarized electromagnetic energy received in the first distinct frequency band and having a first circular polarization, into linearly polarized electromagnetic energy prior to being received by the one or more antennas; and configured to convert the polarization of linearly polarized electromagnetic energy in the second distinct frequency band, as transmitted by the one or more antennas, into a second circular polarization, orthogonal to the first circular polarization.

According to another aspect, dichroic polarizer includes: an array of unit cells distributed across a sheet; wherein the unit cells each include a stack of one or more resonant structures, the stack configured to introduce a phase differential of approximately +90° to linearly polarized electromagnetic energy within one of the first distinct frequency band and the second distinct frequency band that is incident upon and passes through the sheet, and configured to introduce a phase differential of approximately −90° to linearly polarized electromagnetic energy within the other of the first distinct frequency band and the second distinct frequency band that is incident upon and passes through the sheet.

In accordance with another aspect, the sheet comprises m stacked layers (where m is an integer equal to or greater than 2), and each of the unit cells includes a stack of resonant structures formed respectively in or on the stacked layers.

According to another aspect, the stacked resonant structures in each unit cell individually introduce a phase differential of approximately +90°/m to the linearly polarized electromagnetic energy within the first distinct frequency band and a phase differential of approximately −90°/m to the linearly polarized electromagnetic energy within the second distinct frequency band.

In yet another aspect, m equals 4.

According to another aspect, the sheet comprises a dielectric sheet.

In accordance with still another aspect, the first distinct frequency band is in the K-band spectrum and the second distinct frequency band is in the Ka-band spectrum.

In another aspect, constituent parts of each resonant structure include at least two different patches and/or apertures selected from a group of geometries consisting of a monopole structure, a cross-structure, complementary corner structures, a Jerusalem cross-structure, and a turnstile structure.

According to another aspect, the constituent parts include a cross-structure and complementary corner structures.

In yet another aspect, the one or more antennas comprises a single-polarization wideband antenna which can simultaneously cover both the first and second distinct frequency bands with a single common aperture.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

In the annexed drawings, like references indicate like parts or features:

FIG. 4A(ii) illustrates its corresponding ΔS21 phase plot;

FIG. 4B(ii) illustrates its corresponding ΔS21 phase plot;

FIG. 4C(ii) illustrates its corresponding ΔS21 phase plot;

Figure 5A:
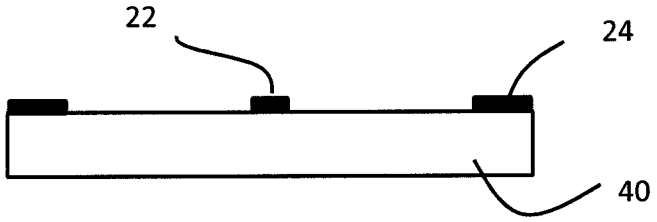
FIG. 5A is a cross-section of the exemplary unit cell structure shown in FIG.
Figure 5B:
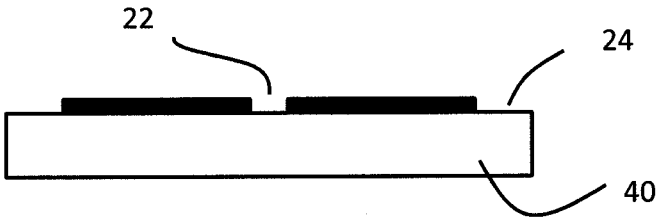
Figure 6A:
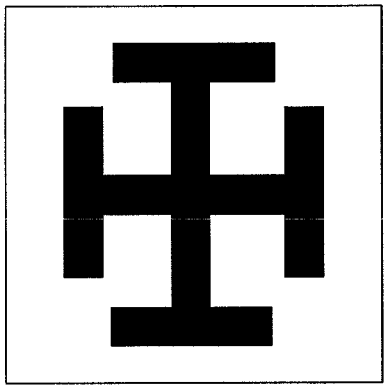
Figure 6B:
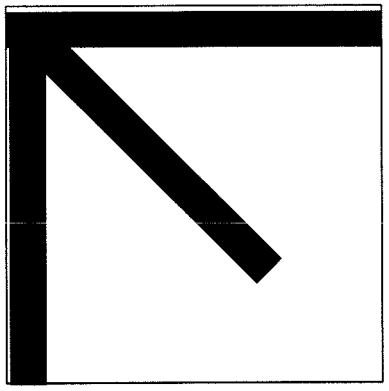
Figure 7A:
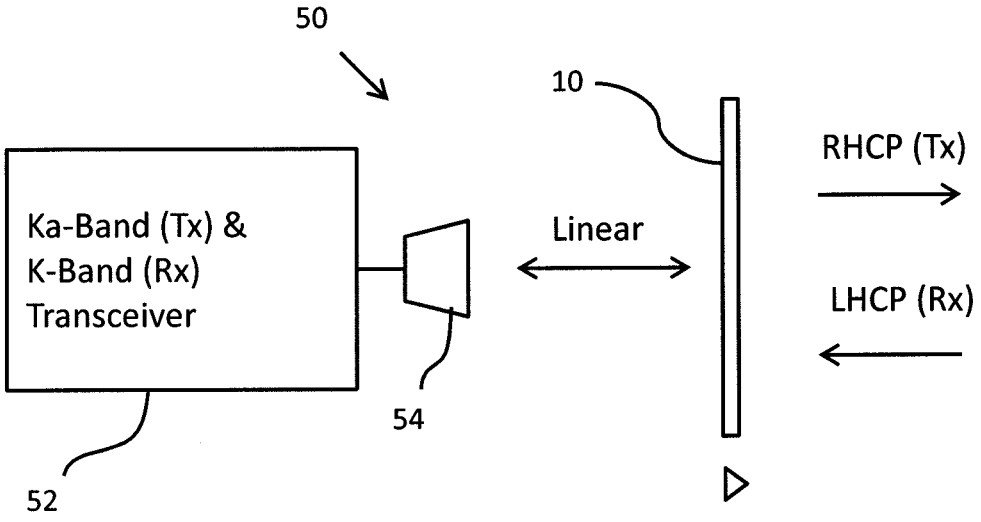
Figure 7B:
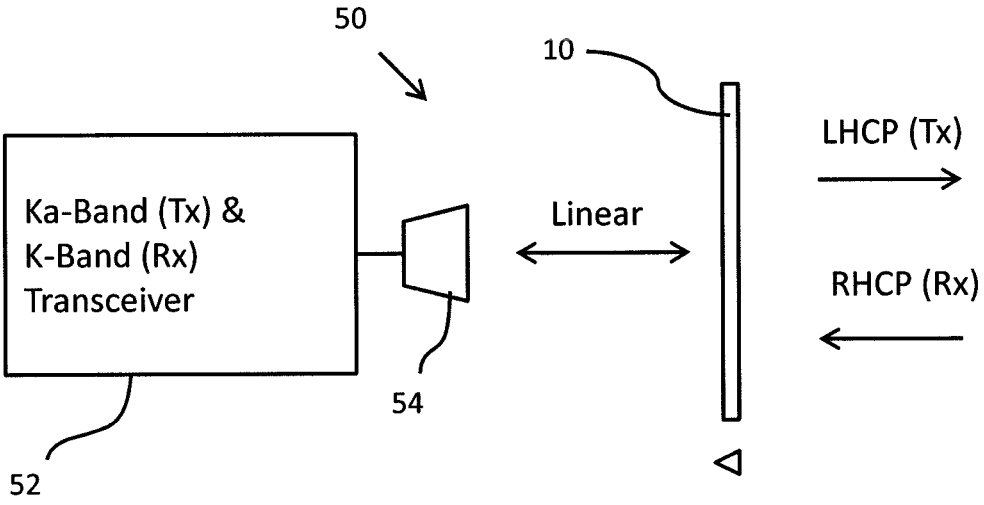

3A;

FIG. 5B is a cross-section of an exemplary unit cell structure which is the complement of the unit cell structure shown in FIG. 5A;

FIGS. 6A and 6B represent respective unit cell structure geometries in accordance with alternative embodiments of the invention;

FIGS. 7A and 7B illustrate exemplary embodiments of a system incorporating a dual-band dichroic polarizer in accordance with the invention.

DETAILED DESCRIPTION OF INVENTION

The present invention is described with respect to various embodiments. Like references are used to refer to like elements throughout.

The term "dichroic" has been used in several different contexts in the science world. A dichroic polarizer, as the term is used herein, refers to a polarizer capable of converting an input linearly polarized wave in first and second distinct frequency bands into respective opposite circular polarization senses. In a preferred embodiment, the CP assignments can be switched by physically reversing the polarizer. This greatly simplifies the architectural complexity of a single aperture antenna system which must provide oppositely polarized CP signals in different frequency bands.

In particular, the described dichroic polarizer is capable of providing the simultaneous dual-polarization and dual-band capability of a much more complicated dual-polarized dual-band radiating aperture, but via a much simpler and less expensive single-polarized aperture implementation. In addition, both senses of orthogonal polarization may be interchanged (RHCP/LHCP becomes LHCP/RHCP) via a simple mechanical flipping of the dichroic polarizer, rather than through the much more complex switched network or orthomode transducer as required in conventional implementations.

As is known, if a linearly polarized electromagnetic wave (also referred to herein as "electromagnetic energy") is incident on a quarter-wave plate at 45° to the reference axis, then the electromagnetic wave is divided into two equal electric field components. One of these is retarded by a quarter wavelength by the plate. This produces a circularly polarized electromagnetic wave. Conversely, incident circularly polarized light will be converted to linearly polarized light.

Figure 1:
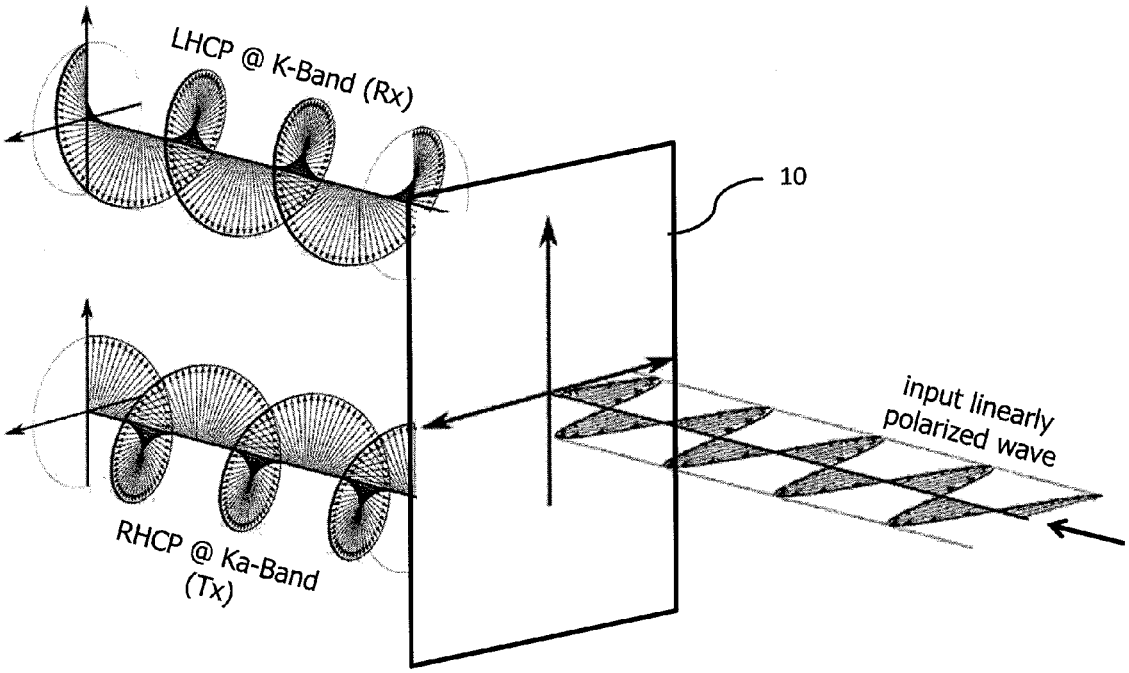
FIG. 1 is a functional diagram of a dichroic polarizer in accordance with the invention.

Referring to FIG. 1, a dichroic polarizer 10 is provided for converting linearly polarized input electromagnetic energy in a first distinct frequency band to one sense of CP (e.g, LHCP), and for converting linearly polarized input electromagnetic energy in a second distinct frequency band, separate from the first, to the opposite sense of CP (e.g., RHCP). Specifically, the polarizer 10 is configured to function as a +90° quarter-wave plate with respect to the input electromagnetic energy within the first band. At the same time, the polarizer 10 is configured to function as a −90° quarter-wave plate in the second band. The CP assignments can be switched by physically flipping the polarizer over. This greatly simplifies the architectural complexity of a single aperture antenna system which must provide oppositely polarized CP signals in different band spectrums (e.g., K and Ka-Bands).

More generally, the polarizer 10 has insertion phases of approximately +90° and −90° with respect to the linearly polarized input electromagnetic radiation in the first and second bands, respectively. As utilized herein, "approximately +90°" refers to a phase differential of +90°±15°. Similarly, "approximately −90°" refers to a phase differential of −90°±15°. More preferably, however, the insertion phases may be +90°±10° and −90°±10°, respectively, and even more preferably +90°±5° and −90°±5°, respectively. Unless clearly utilized otherwise herein, the broadband response of the polarizer 10 is defined by the width of the response within each band during which the insertion phase of the polarizer 10 remains within +90°±15° and −90°±15°, respectively.

According to an exemplary embodiment, the polarizer 10 is made up of a frequency selective surface (FSS) array of unit cells formed across a sheet as is described in more detail below. The unit cells each include a stack of one or more resonant structures. The stack of unit cells is configured to introduce a phase differential of approximately +90° to linearly polarized electromagnetic energy within a first distinct frequency band that is incident upon and passes through the sheet. The stack is also configured to introduce a phase differential of approximately −90° to linearly polarized electromagnetic energy within a second distinct frequency band, separate from the first distinct frequency band, that is incident upon and passes through the sheet. The linear polarization of the electromagnetic energy in the first distinct frequency band and linear polarization of the electromagnetic energy in the second distinct frequency band are the same.

Figure 2:
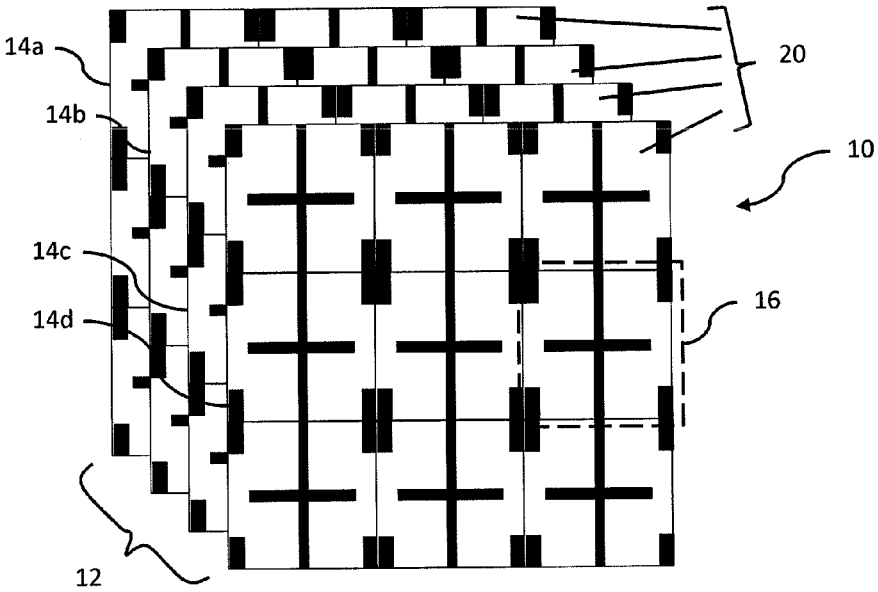
FIG. 2 is an exploded view of the dual-band dichroic polarizer in FIG. 1 in accordance with a first embodiment of the invention.

Referring to FIG. 2, the polarizer 10 in accordance with a first embodiment includes a sheet 12 which in the exemplary embodiment includes four (m=4) stacked layers 14*a*-14*d*. The sheet 12 includes an array of resonant structures 16 formed on each of the stacked layers 14*a*-14*d*. The resonant structures 16 within the array are preferably identical with respect to those on the same layer 14 as well as those in or on the other layers 14. The resonant structures 16 in or on each layer 14 are aligned with corresponding resonant structures 16 on any overlying or underlying layer 14. Consequently, the sheet 12 is made up of an array of unit cells 20 with each of the unit cells 20 being represented by a corresponding stack of resonant structures 16 formed in or on the respective layers 14.

In the exemplary embodiment, each of the layers 14 includes a layer of dielectric material. The resonant structures 16 may be formed of conductive material (e.g., copper) deposited, etched, adhered or otherwise formed on the dielectric material using any conventional technique. In another embodiment, each of the layers 14 may be made of a thin sheet of conductive material (e.g., copper) on one or both sides of the dielectric sheet, or with multiple thin sheets. The resonant structures 16 may be represented by apertures formed in each of the respective sheets. Thickness of the dielectric material, spacing between the conductive sheets, dielectric constant, etc., is determined using conventional techniques well known in connection with the design of FSS surfaces. Similarly, other known techniques for constructing FSS surfaces may be utilized to form the resonant structures 16 without departing from the scope of the present application. For example, at lower frequencies, discrete components such as chip capacitors and inductors can be incorporated in lieu of distributed structures.

The sheet 12 in the present embodiment includes four layers 14 as previously mentioned. However, other numbers of layers 14 may be used as will be appreciated. Assume "m" represents the number of layers 14, and m is an integer equal to or greater than one). Fundamentally, each of the stacked resonant structures 16 in a given unit cell 20 introduces a phase differential of approximately +90°/m to the linearly polarized electromagnetic energy within the first distinct frequency band, with respect to electromagnetic energy which is incident upon and passes through the polarizer 10. Moreover, each of the stacked resonant structures 16 introduces a phase differential of approximately −90°/m to the linearly polarized electromagnetic energy within the second distinct frequency band, with respect to electromagnetic energy incident upon and passing through the polarizer 10. Thus, electromagnetic energy which passes through a given unit cell 20 consisting of m layers 14 will undergo a phase differential of ±90°, depending upon the particular frequency band.

While the transmitted phase differential through each unit cell is a good primary descriptor to characterize dichroic polarizer performance, it is not the only metric. A good polarizer design will also be designed for good return loss match (S11<−10 dB) for each of the two orthogonal polarizations in order to minimize reflections as well as exhibit low axial ratio (AR<2.0 dB) in order to demonstrate good conversion to circular polarization. These metrics should be optimized simultaneously in both bands by fine tuning the trace artwork and/or varying the dielectric stackup materials and layer thicknesses.

Figure 3A:
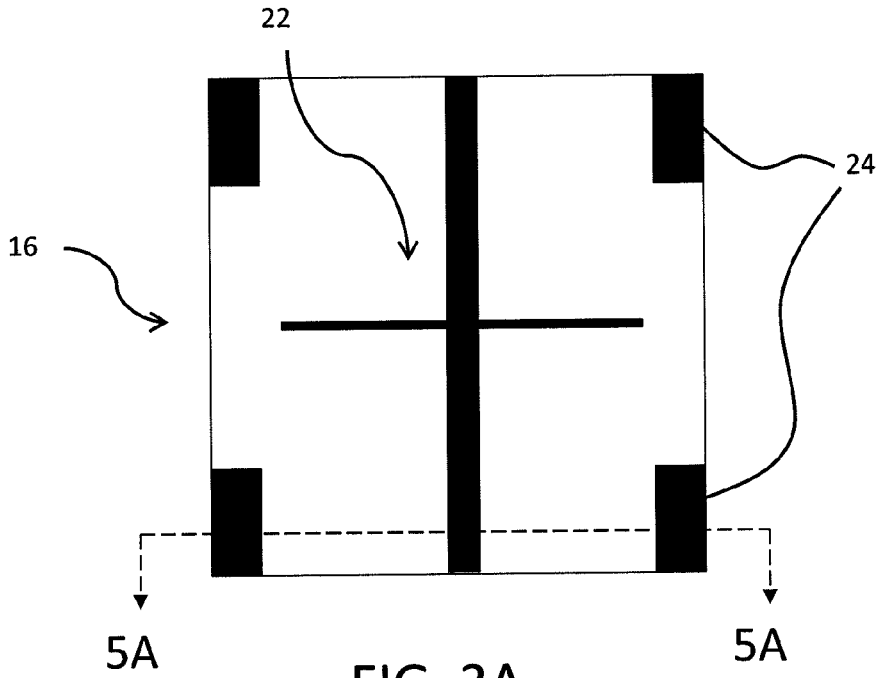
FIG. 3A shows an exemplary unit cell structure for the dual-band dichroic polarizer of FIG. 1.

FIG. 3A illustrates a resonant structure 16 in accordance with the first embodiment. The resonant structure 16 is made up of constituent parts represented by geometric patterns of a simple cross 22 and complementary corner patches 24 as are known. To achieve the above-described desired dichroic properties, each resonant structure 16 is designed so that it resonates roughly halfway between the first distinct frequency band and the second distinct frequency band.

In the present embodiment, it is desired that the polarizer 10 functions in the K-band and Ka-band. Accordingly, each resonant structure 16 is designed to resonate approximately between receive (Rx) band (K-Band) and transmit (Tx) band (Ka-Band) frequency spectrums. For the present example, the first and second distinct frequency bands are desired to be centered approximately at 20 gigahertz (GHz) and 30 GHz, respectively.

Figure 3B:
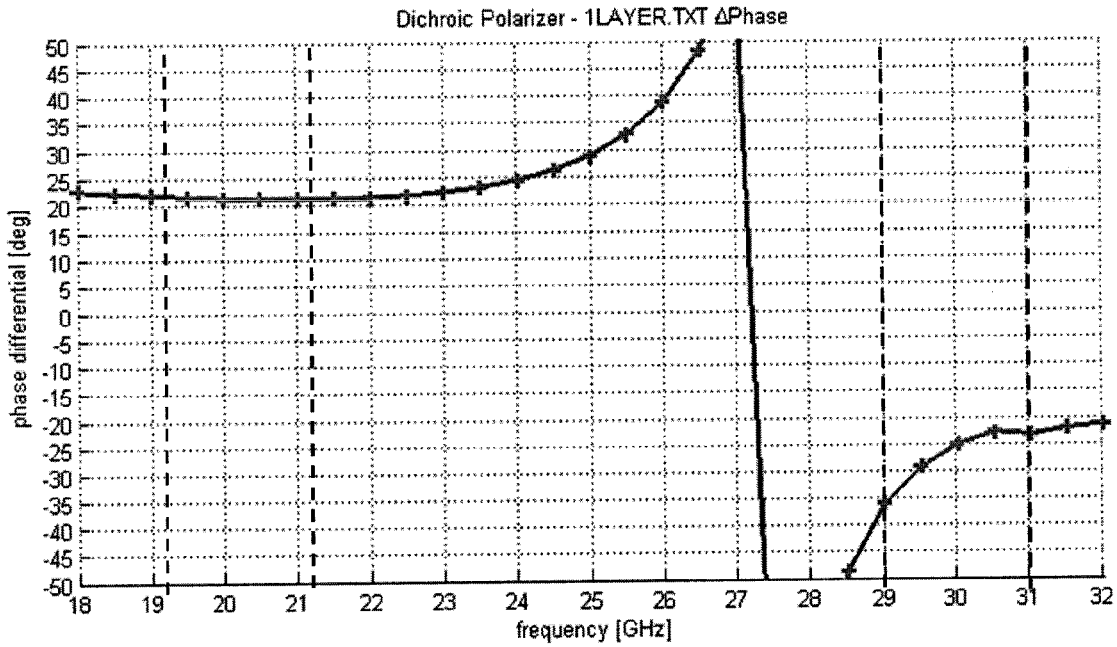
FIG. 3B illustrates its corresponding ΔS21 phase plot.

FIG. 3B is the simulated ΔS21 phase plot for the resonant structure 16 shown in FIG. 3A. For reasons explained more fully below, when put together the simple cross 22 and corner patches 24 complement each other and form a better broader band dichroic polarizer in both the Rx and Tx bands than the constituent structures in and of themselves.

In the present example, the first distinct frequency band is 19.2 GHz~21.2 GHz, and the second distinct frequency band is 29 GHz~31 GHz. As shown in FIG. 3B, each resonant structure 16 has a phase differential of approximately +22.5° and −22.5° at or near the center of the respective band. Since there are four resonant structures 16 in a given unit cell 20, the overall unit cell 20 provides four times the phase differential of approximately +22.5° and −22.5°, or approximately +90° and −90° in total with respect to linearly polarized electromagnetic energy in the respective bands passing through the polarizer 10.

As described earlier, "approximately +90°" and "approximately −90°" refers to the insertion phase or phase differential of the polarizer 10 remaining within +90°±15° and −90°±15°, respectively (or +22.5°±2.5° and −22.5°±2.5° with respect to each of the resonant structures 16 in a given unit cell 20). FIG. 3B illustrates the response of each resonant structure 16. The bandwidth of the resonant structure 16 (in the present example, the response within +22.5°±3.75°) in the first distinct frequency band is approximately 10% of the band center frequency of 20.2 GHz. The bandwidth of the resonant structure 16 (in the present example, the response within −22.5°±3.75°) in the second distinct frequency band is approximately 4% of the band center frequency of 30.0 GHz.

Figure 4A:
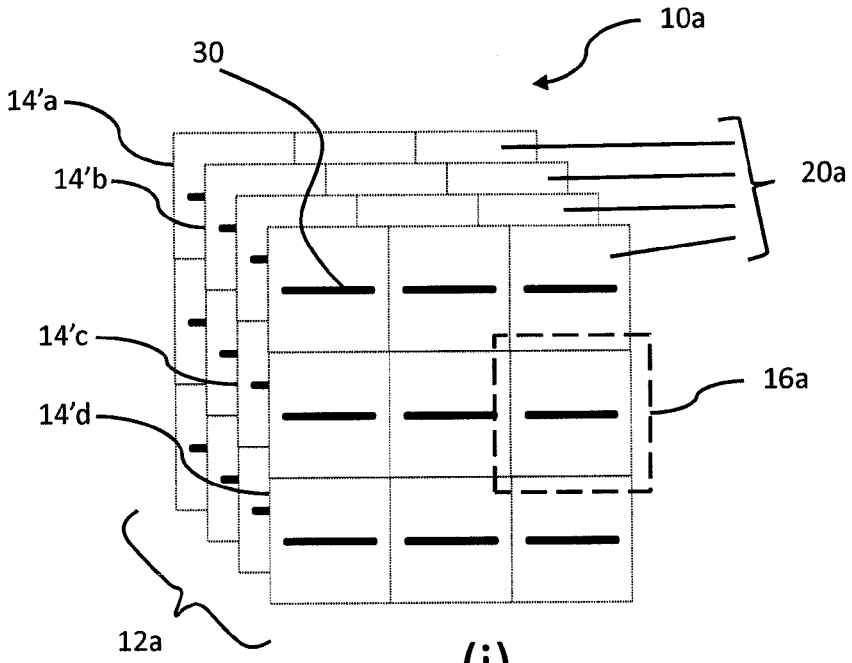
FIG. 4A(i) shows an exploded view of the dual-band dichroic polarizer in accordance with a second embodiment of the invention having a resonant monopole unit cell structure.
Figure 4A:
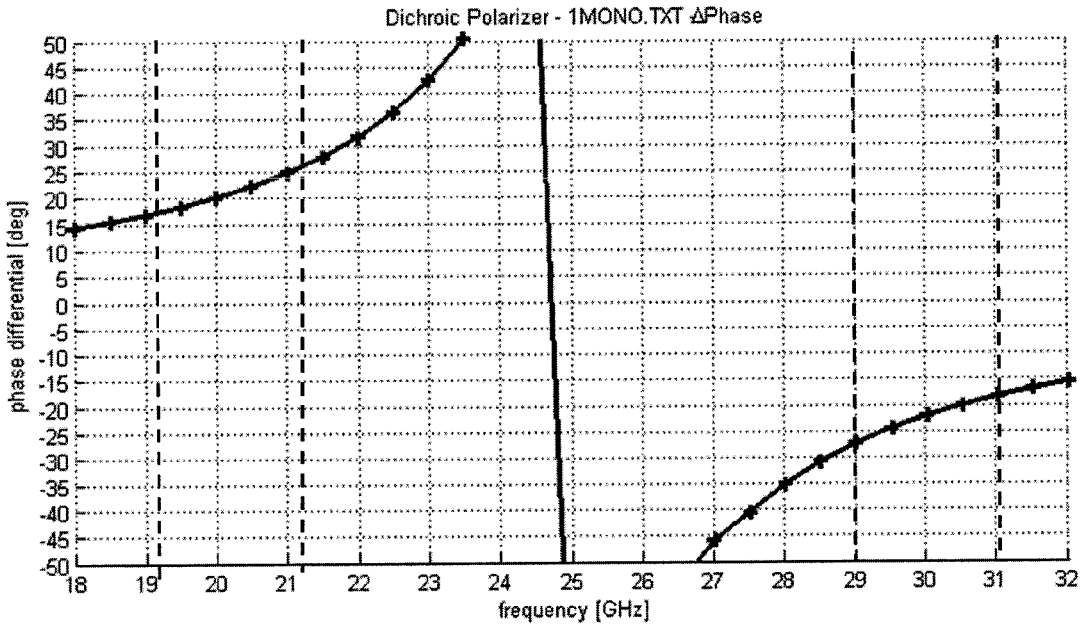
Figure 4B:
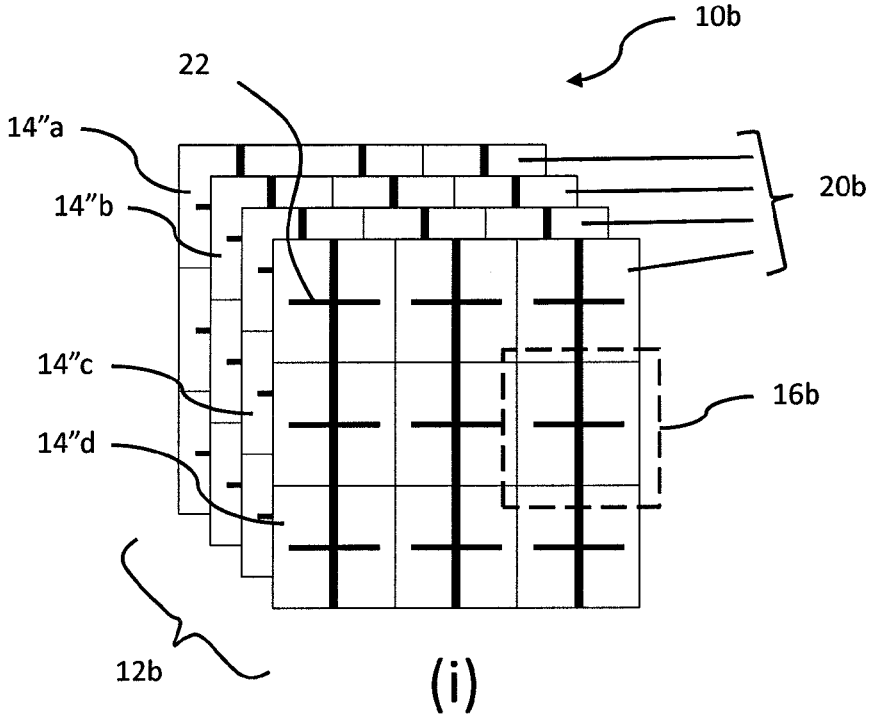
FIG. 4B(i) shows an exploded view of the dual-band dichroic polarizer in accordance with a third embodiment of the invention having a simple cross unit cell structure.
Figure 4B:
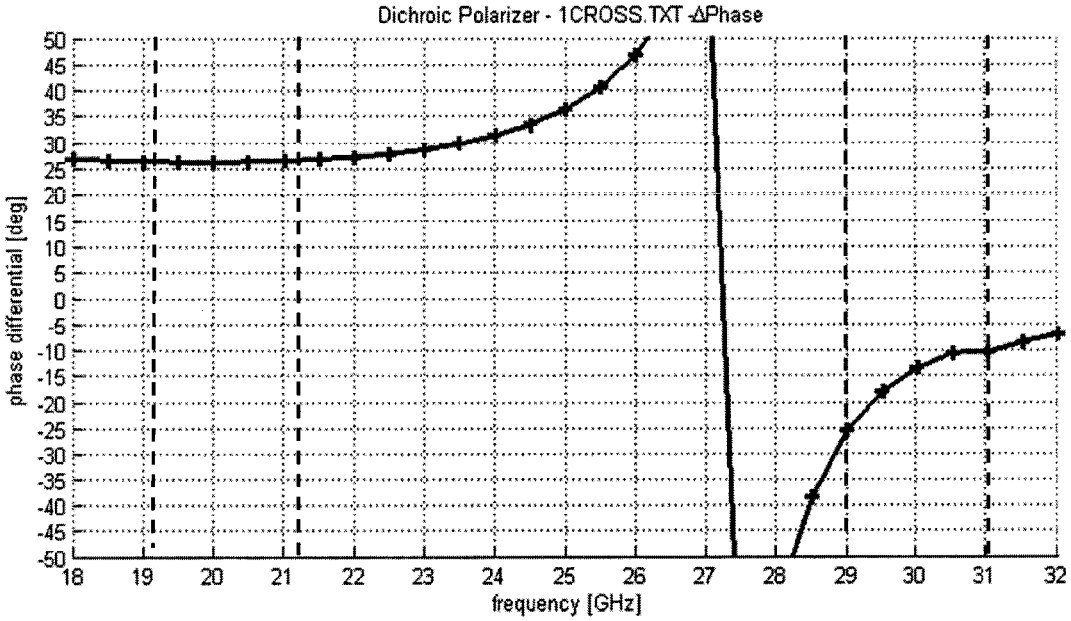
Figure 4C:
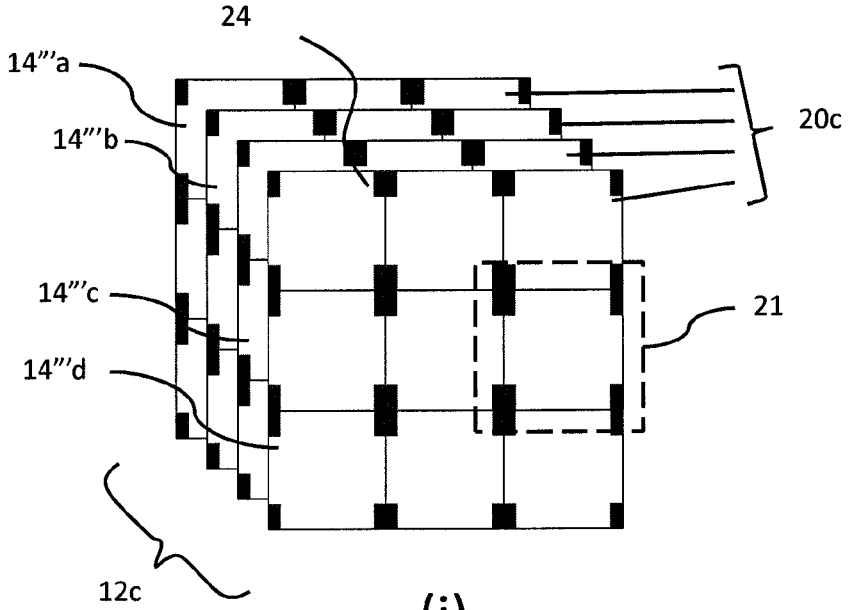
FIG. 4C(i) shows an exploded view of an array of complementary corner patch unit cell structures.
Figure 4C:
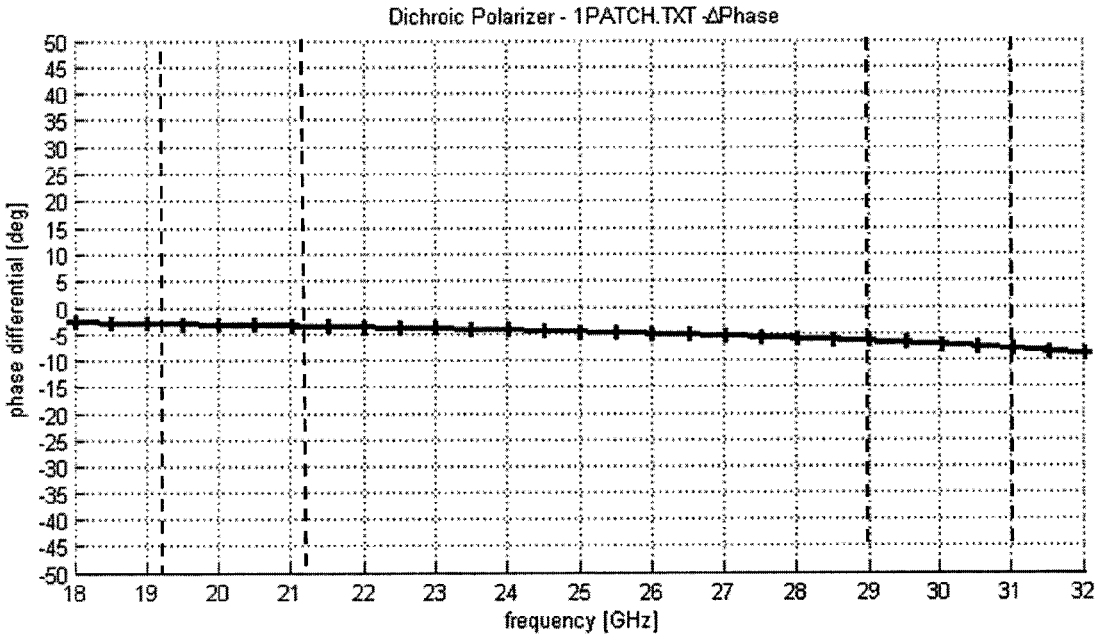

FIGS. 4A and 4B illustrate second and third embodiments of a dichroic polarizer, respectively, in accordance with the present invention. Moreover, FIGS. 4A-4C illustrate exemplary constituent components which may be used to form the resonant structures 16 in the first embodiment of FIGS. 2, 3A and 3B.

FIG. 4A(i) shows an embodiment of the dichroic polarizer 10*a* in the case of the resonant structure 16*a* being a simple monopole 30. FIG. 4A(ii) shows the simulated response of a resonant structure 16*a* in the case of a simple monopole 30. Resonant monopoles are perhaps the simplest structures that one could use to achieve the fundamental dichroic properties described herein. The monopole 30 is similarly designed to resonate between the first and second distinct frequency bands. The monopole 30 in each layer 14' (layers 14'*a*-14'*d*) provides approximately +22.5° of transmission phase in the lower (Rx) band and approximately −22.5° of phase in the higher (Tx) band. With 4-layers stacked together, the effective transmitted phase again becomes approximately +90° and −90° in the respective bands. The bandwidth is somewhat narrower in comparison to the response of the resonant structure 16 as shown in FIG. 3B, yet still may be suitable in various applications.

More particularly, the corresponding bandwidth of the resonant structure 16*a* in the first distinct frequency band is approximately 8.5% of the band center frequency of 20.2 GHz. The bandwidth of the resonant monopole 30 in the second distinct frequency band is approximately 4.0% of the band center frequency of 30.0 GHz. Thus, the broadband response of the resonant structure 16 in the first embodiment is a bit less than that of the monopole resonant structure 16*a* in the first distinct frequency band while similar to that in the second distinct frequency band. It is noted, however, that the first embodiment with the structures 16 has a flatter response in the first distinct frequency band which can be advantageous.

FIG. 4B(i) shows another embodiment of the dichroic polarizer 10*b* in the case of the resonant structure 16*b* being a simple cross 22. FIG. 4B(ii) shows the simulated response of a resonant structure 16*b* in the case of the simple cross (or cross-structure) 22. Note that the simple cross is continuously connected along its vertical axis when the unit cells are cascaded as shown in FIG. 4B(i). The simple cross 22 is designed to resonate between the first and second distinct frequency bands while balancing the transmitted phase emitted inside each band. The simple cross 22 in each layer 14" (layers 14"*a*-14"*d*) provides approximately +26.0° of transmission phase in the lower (Rx) band and approximately −22.5° of phase differential in the higher (Tx) band. With 4-layers 14"*a*-14"*d* stacked together, the effective transmitted phase becomes approximately +104° and −90° in the respective bands.

More particularly, the corresponding bandwidth of the simple cross 22 in the first distinct frequency band is approximately 10% of the band center frequency of 20.2 GHz. The bandwidth of the simple cross 22 in the second distinct frequency band is approximately 1.3% of the band center frequency of 30.0 GHz. Thus, the broadband response of the resonant structure 16*a* of the first embodiment is improved over the simple cross 22 itself in both the first and second distinct frequency bands.

FIG. 4C(i) shows a corresponding array of complementary corner patches 24 for each given structure 21. FIG. 4C(ii) shows the simulated response of a structure in the case of complementary corner patches 24. The corner patches 24 are mostly transparent to the transmission path while providing a small but beneficial negative phase slope in the second distinct frequency band. Thus, when combined with the simple cross structure 22 in the embodiment of FIG. 4B the ΔS21 phase response effectively adds to the response to produce the improved response of the first embodiment shown in FIGS. 2, 3A and 3B.

The inventors have found that one can take basic constituent structures and combine the structures in such a way as to improve the dichroic response which is contrary to conventional design. For the above example, the narrowband response of the monopole can be improved by using alternate geometries like a cross-structure. By going to the cross-structure, the phase response in the lower distinct frequency band flattens out nicely but at the expense of increasing the slope of the response in the upper distinct frequency band. The addition of the complementary patches, which are mostly benign at the lower band, provide a modest phase slope in the upper band to help flatten out the response of the cross-structure. Thus, the combination of the simple cross and the complementary patches can achieve a more broadband response than a dichroic polarizer made singly by the constituent parts. Moreover, low axial ratio values indicate good circular polarization.

FIG. 5A illustrates a cross-section taken along line 5A-5A shown in FIG. 3A. In this case, the resonant structure 16 is made up of the simple cross 22 and corner patches 24 formed of copper on a dielectric substrate 40. As another alternative, the simple cross 22 and corner patches 24 may be represented by apertures formed in a sheet of copper formed on the dielectric substrate 40.

As previously discussed, a dichroic polarizer 10 is not limited to the particular structures described herein but can take on any number of possible geometries/implementations such as the Jerusalem cross, turnstiles, and even lumped component varieties. (See, e.g., FIGS. 6A and 6B). Moreover, the invention is by no means limited to the particular frequencies and frequency bands in its broadest sense. Furthermore, the first distinct frequency band may be lower in frequency than the second distinct frequency band or vice versa. The dichroic polarizer can be designed using the principles described herein for virtually any frequency ranges.

Referring now to FIGS. 7A and 7B, a system 50 for transmitting and receiving electromagnetic energy is shown. The system 50 includes a receiver configured to receive electromagnetic energy within a first distinct frequency band (e.g., 19.2 GHz~21.2 GHz), and a transmitter configured to transmit electromagnetic energy within a second distinct frequency band (e.g., 29 GHz~31 GHz), separate from the first distinct frequency band. The transmitter and receiver are illustrated collectively as a transceiver 52 in FIGS. 7A and 7B, although it will be appreciated the transmitter and receiver may be discrete components without departing from the intended scope of the system.

The system 50 further includes one or more antennas 54 operatively configured to transmit and receive the electromagnetic energy in the first and second distinct frequency ranges with a same linear polarization. In a preferred embodiment, the one or more antennas 54 is made up of a wideband antenna which can simultaneously cover both the first and second distinct frequency bands with a single common aperture.

Additionally, the system 50 includes a dual-band dichroic polarizer 10 as described above in connection with any of the embodiments. The polarizer 10 is configured to convert circularly polarized electromagnetic energy (e.g., LHCP or RHCP) received in the first distinct frequency band into linearly polarized electromagnetic energy prior to being received by the one or more antennas 54. The polarizer 10, as described above, also is configured to convert the polarization of the linearly polarized electromagnetic energy in the second distinct frequency band, as transmitted by the one or more antennas 54, into the opposite circular polarization (e.g., conversely RHCP or LHCP), orthogonal to the circular polarization within the first distinct frequency band.

Referring specifically to FIG. 7A, the orientation of the polarizer 10 (represented by the small arrow) provides for electromagnetic energy to be transmitted with RCHP and received via LHCP. By simply flipping or reversing the orientation of the polarizer 10 (again as represented by the small arrow), the system 50 is able to transmit with LHCP and to receive with RHCP.

Thus, the dichroic polarizer 10 as described herein is particularly suitable for single-polarization broadband antenna terminals which can cover multiple frequency spectrums (e.g., both K- and Ka-band). This polarizer 10 enables such terminals to output dual-orthogonal circular polarization signals in each of the respective and distinct Rx/Tx bands. This polarizer would also enable terminals employing circularly polarized apertures to output dual orthogonal linear polarization.

Although the invention has been shown and described with respect to a certain embodiment or embodiments, equivalent alterations and modifications may occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein exemplary embodiment or embodiments of the invention. In addition, while a particular feature of the invention may have been described above with respect to only one or more of several embodiments, such feature may be combined with one or more other features of the other embodiments, as may be desired and advantageous for any given or particular application.

The invention claimed is:

1. A dual-band dichroic polarizer for converting linearly polarized electromagnetic energy within distinct frequency bands into oppositely polarized circularly polarized electromagnetic energy, comprising:

an array of unit cells distributed across a sheet;

wherein the unit cells each include at least one of a resonant structure or a plurality of resonant structures stacked one over the other, the at least one resonant structure or stacked resonant structures configured to introduce a phase differential of approximately +90° to linearly polarized electromagnetic energy within a first distinct frequency band that is incident upon and passes through the sheet, and configured to introduce a phase differential of approximately −90° to linearly polarized electromagnetic energy within a second distinct frequency band, separate from the first distinct frequency band, that is incident upon and passes through the sheet, a linear polarization of the electromagnetic energy in the first distinct frequency band and a linear polarization of the electromagnetic energy in the second distinct frequency band being the same, wherein constituent parts of each resonant structure include at least two different patches or apertures, and at least one of the constituent parts comprises complementary corner structures arranged in each corner of the unit cell, the complementary corner structures separate and distinct from the other of the at least two different patches or apertures, and wherein at least one of the corner structures is immediately adjacent to a corner structure of an adjacent unit cell.

2. The polarizer according to claim 1, wherein the sheet comprises m stacked layers (where m is an integer equal to or greater than 2), and each of the unit cells includes a stack of resonant structures formed respectively in or on the stacked layers.

3. The polarizer according to claim 2, wherein the at least one resonant structure or stacked resonant structures in each unit cell individually introduce a phase differential of approximately +90°/ m to the linearly polarized electromagnetic energy within the first distinct frequency band and a phase differential of approximately −90°/m to the linearly polarized electromagnetic energy within the second distinct frequency band.

4. The polarizer according to claim 3, wherein m equals 4.

5. The polarizer according to claim 1, wherein the sheet comprises a dielectric sheet.

6. The polarizer according to claim 1, wherein the first distinct frequency band is in the K-band spectrum and the second distinct frequency band is in the Ka-band spectrum.

7. The polarizer according to claim 1, wherein constituent parts of each resonant structure include at least two different patches and/or apertures selected from a group of geometries consisting of a monopole structure, a cross-structure, complementary corner structures, a Jerusalem cross-structure, and a turnstile structure.

8. The polarizer according to claim 7, wherein the constituent parts include a cross-structure and complementary corner structures.

9. The polarizer according to claim 1, wherein each resonant structure comprises at least one of a monopole and simple cross.

10. A system for transmitting and receiving electromagnetic energy, comprising:

a receiver configured to receive electromagnetic energy within a first distinct frequency band;

a transmitter configured to transmit electromagnetic energy within a second distinct frequency band, separate from the first distinct frequency band;

one or more antennas operatively configured to receive and transmit the electromagnetic energy in the first and second distinct frequency ranges with a same linear polarization; and a dual-band dichroic polarizer configured to convert circularly polarized electromagnetic energy received in the first distinct frequency band and having a first circular polarization, into linearly polarized electromagnetic energy prior to being received by the one or more antennas, and configured to convert the polarization of linearly polarized electromagnetic energy in the second distinct frequency band, as transmitted by the one or more antennas, into a second circular polarization, orthogonal to the first circular polarization, the dual-band dichroic polarizer comprising an array of unit cells distributed across a sheet, wherein the unit cells each include at least one resonant structure or a plurality of resonant structures one stacked one over the other, and wherein constituent parts of each resonant structure include at least two different patches or apertures, and at least one of the constituent parts comprises complementary corner structures arranged in each corner of the unit cell, the complementary corner structures separate and distinct from the other of the at least two different patches or apertures, and wherein at least one of the corner structures is immediately adjacent to a corner structure of an adjacent unit cell.

11. The system of claim 10, wherein the at least one resonant structure or stack of resonant structures is configured to introduce a phase differential of approximately +90° to linearly polarized electromagnetic energy within one of the first distinct frequency band and the second distinct frequency band that is incident upon and passes through the sheet, and configured to introduce a phase differential of approximately −90° to linearly polarized electromagnetic energy within the other of the first distinct frequency band and the second distinct frequency band that is incident upon and passes through the sheet.

12. The system according to claim 11, wherein the sheet comprises m stacked layers (where m is an integer equal to or greater than 2), and each of the unit cells includes a stack of resonant structures formed respectively in or on the stacked layers.

13. The system according to claim 11, wherein the stacked resonant structures in each unit cell individually introduce a phase differential of approximately −90°/m to the linearly polarized electromagnetic energy within the first distinct frequency band and a phase differential of approximately −90°/m to the linearly polarized electromagnetic energy within the second distinct frequency band.

14. The system according to claim 13, wherein m equals 4.

15. The system according to claim 11, wherein the sheet comprises a dielectric sheet.

16. The system according to claim 11, wherein the first distinct frequency band is in the K-band spectrum and the second distinct frequency band is in the Ka-band spectrum.

17. The system according to claim 11, wherein constituent parts of each resonant structure include at least two different patches and/or apertures selected from a group of geometries consisting of a monopole structure, a cross-structure, complementary corner structures, a Jerusalem cross-structure, and a turnstile structure.

18. The system according to claim 11, wherein the constituent parts include a cross-structure and complementary corner structures.

19. The system according to claim 10, wherein the one or more antennas comprises a single-polarization wideband antenna which can simultaneously cover both the first and second distinct frequency bands with a single common aperture.

20. The polarizer according to claim 1, wherein each resonant structure comprises a cross-structure having a first elongated part extending lengthwise in a first direction and a second elongated part extending lengthwise in a second direction, the first elongated part intersecting the second elongated part, wherein a width of the first elongated part is different from a width of the second elongated part.

* * * * *